United States Patent [19]

Kamp

[11] 4,233,810

[45] Nov. 18, 1980

[54] DEVICE FOR AUTOMATICALLY REMOVING A COIL FROM A SPINDLE OF A RING SPINNING FRAME OR A RING TWISTER

[75] Inventor: Heinz Kamp, Wegberg, Fed. Rep. of Germany

[73] Assignee: W. Schlafhorst & Co., Mönchen-Gladbach, Fed. Rep. of Germany

[21] Appl. No.: 970,394

[22] Filed: Dec. 18, 1978

[30] Foreign Application Priority Data

Dec. 17, 1977 [DE] Fed. Rep. of Germany ..... 2756397

[51] Int. Cl.[3] ..... D01H 9/10

[52] U.S. Cl. ..... 57/270; 57/271; 57/273; 57/275

[58] Field of Search ..... 57/268, 270, 271, 273, 57/274, 275

[56] References Cited

U.S. PATENT DOCUMENTS

| | | | |
|---|---|---|---|
| 3,117,408 | 1/1964 | Fisher | 57/273 |
| 3,176,458 | 4/1965 | Dubois et al. | 57/271 |
| 3,292,355 | 12/1966 | Dubois | 57/271 |
| 3,307,340 | 3/1967 | Nishii et al. | 57/271 |
| 3,350,868 | 11/1967 | Winter | 57/275 |
| 3,433,006 | 3/1969 | Hamahata | 57/271 X |
| 3,566,597 | 3/1971 | Para | 57/271 |
| 3,633,959 | 1/1972 | McCollough et al. | 57/275 X |
| 3,992,866 | 11/1976 | Chiari et al. | 57/271 |

*Primary Examiner*—John Petrakes

*Attorney, Agent, or Firm*—Herbert L. Lerner

[57] ABSTRACT

Method of automatically removing a coil from a spindle of a ring spinning or twisting-frame work station which includes driving along the frame and traveling device equipped with a coil transporter; in a first operating cycle, releasing a coil core from a spindle by means of a coil-core releasing device while applying in axial direction compressive forces symetrically and over a large area upon a lower edge of the coil core; and in a second operating cycle, gripping the thus released coil by means of the coil transporter, raising the coil above the respective spindle and thereafter transporting the coil to a side of the frame and depositing the coil thereat and device for performing the method.

6 Claims, 8 Drawing Figures

DEVICE FOR AUTOMATICALLY REMOVING A COIL FROM A SPINDLE OF A RING SPINNING FRAME OR A RING TWISTER

The invention relates to a method and a device for automatically removing a coil from a spindle of a ring spinning frame or a ring twister work station.

It has already become known heretofore to remove fully wound coils from the spindles by means of a device that is movable or can travel along the spinning frame or twister. Either the tip of the coil core or tube protruding above from the coil is gripped and the coil core or tube and coil are drawn off the spindle, or a gripper is applied from one side to the lower end of the coil core or tube, whereupon the coil core or tube is ejected from the spindle upwardly over the tip of the spindle. After the ejection, a coil catching or collecting device can become operative.

Heretofore known devices of this general type are not suitable for drawing off coils with thin or weak coil tubes. Such coil cores or tubes are relatively easily damaged.

The thread also cannot unwind rapidly enough when the coil is being ejected, which causes excessive overstressing and thread breaks.

It is accordingly an object of the invention to provide a method and device for the automatic removal of coils having weak, thin or soft coil cores or tubes free of any trouble and while avoiding the hereinaforedescribed disadvantages of the heretofore known methods and devices of this general type.

With the foregoing and other objects in view, there is provided, in accordance with the invention, a method of automatically removing a coil from a spindle of a ring spinning or twisting-frame work station which comprises driving along the frame a traveling device equipped with a coil transporter; in a first operating cycle, releasing a coil core from a spindle by means of a coil-core releasing device while applying in axial direction compressive forces symmetrically and over a large area upon a lower edge of the coil core; and in a second operating cycle, gripping the thus released coil by means of the coil transporter, raising the coil above the respective spindle and thereafter transporting the coil to a side of the frame and depositing the coil thereat. Before the removal per se of the coil, a force is applied symmetrically and over a large area to the lower edge of the coil core or tube in order initially to loosen or release the coil core or tube from the spindle. Soft, weak or thin coil cores or tubes, in fact, are connected very firmly to the spindle by the coil wound on the coil core or tube. Where other methods fail, it is possible with the method according to the invention to lift such coils also gently off the spindles and to further transport them.

Since the coils are lifted by the coil transporter in a second operation relatively slowly and gently above the spindle and are subsequently further transported and deposited, the thread is also not stressed unduly.

In accordance with another mode of the method invention, wherein the work station includes a ring coil carrying a twisting or spinning ring, the method includes lowering the ring coil and the ring below the foot of the coil core, prior to releasing the coil core.

In accordance with a further mode of the method invention, wherein the work station includes a twisting or spinning ring and a ring traveler revolvable thereon, the method includes blowing with compressed air the ring traveler and a thread extending therethrough out of working range of the coil-core releasing device, prior to releasing the coil core.

In accordance with another aspect of the invention, there is provided a device for performing the method of automatically removing a coil from spindles of a ring spinning or twisting frame work station comprising an axially displaceable coil-core releasing ring operatively associated with each spindle of the work station a traveling device drivable from work station to work station along the frame; the traveling device having means connectible with the releasing ring for releasing a coil core from a respecitive spindle whereon the coil core is mounted, and having a coil transporter connectible to the respective coil, the coil transporter being displaceable in a direction parallel to the respective spindle axis and with a component of motion perpendicular to the parallel direction. The releasing ring respectively associated with every spindle ensures that the axially directed compressive forces can act over a large area and symmetrically on the lower edge of the coil core or tubes. The tube loosener or releasing device is separated from the coil transporter. The coil transporter initially raises the coil above the tip of the spindle and then delivers it into a deposited position to one side by shifting or swinging and, if necessary or desirable while raising or also lowering it further.

In accordance with another feature of the device according to the invention, a spinning or twisting ring is located at the respective work station, and the traveling device has blasting means comprising a blasting nozzle directed toward the spinning or twisting ring.

In accordance with a further feature of the device according to the invention, the releasing ring has a smooth outer surface and a diameter at an upper end thereof that is at most equal to the outer diameter of the foot of the coil core.

In accordance with an added feature of the device invention, the coil transporter has an elevating or lifting device rotatable about an axis parallel to the respective spindle axis, the elevating device comprising at least two coil grippers distributed about the circumference thereof, the coil grippers being activatable and deactivatable sequentially.

In accordance with an additional feature of the device invention, the coil grippers are mechanically acting gripper clamps.

In accordance with a concomitant feature of the device invention, the coil grippers are pneumatically acting suction nozzles.

If the traveling device has a blasting device, the blasting nozzle of which is directed toward the spinning or twisting ring, the ring traveler and thread can advantageously first be blown out of the working range of the tube loosener or releasing device in the blast direction before the tube loosener or releasing device becomes operative.

A smooth outer surface of the releasing ring permits the last coil core or foot turns or windings to slide off unhindered as soon as the ring rail and the ring are lowered below the foot of the coil core or tube.

Also, the matching of the upper diameter of the releasing ring to the diameter of the coil-core or tube foot serves the same purpose.

Especially advantageous is a lifting or elevating device which is rotatable about an axis parallel to the spindle axis. Since the elevating device comprises several coil grippers which are disposed in a distribution over the circumference and can be activated and deactivated sequentially, rapid operation without reciprocating movements is possible. Two coil grippers, uniformly distributed over the circumference, would be sufficient; three coil grippers are even better. The coil grippers come into action alternatingly for another coil following next in the direction of travel. The rotary motion of the elevating device of the coil transporter can be coordinated with the travel velocity of the device which travels along the ring spinning or twisting frame.

The coil grippers can be constructed either as mechanically acting gripper clamps or as pneumatically acting suction nozzles. A gripper clamp can, for example, be constructed as a spring clamp and engage the coil in the manner of a snap-on connection. However, the gripper clamp can also be constructed as a mechanically actuatable gripping tongs. A pneumatically acting suction nozzle has the advantage that no mechanically displaced parts are required for directly holding the coil.

The invention offers the following advantages, among others: Two devices which are separate from one another and are dimensioned for mechanical forces of different magnitude are provided for removing the coil. Only the coil-core or tube releasing device is constructed for large mechanical forces. The coil transporter, on the other hand, can have a light-weight construction. Since only the releasing or loosening force is large, in removing the coil from the spindle, but not the holding force, all of the heretofore known devices serving to loosen or release and, simultaneously, also to hold or eject the coil were overdesigned or overdimensioned for the purposes of holding and transporting the coil.

By means of the method and device according to the invention, the coil is loosened or released, removed and deposited with the greatest possible gentleness.

Most of the spacial devices serving for removing the coil are provided only singly for a multiplicity of work stations, namely, in the device which is movable or travels along the machine.

Other features which are considered as characteristic for the invention are set forth in the appended claims.

Although the invention is illustrated and described herein as embodied in method and device for automatically removing a coil from a spindle of a ring spinning frame or a ring twister, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
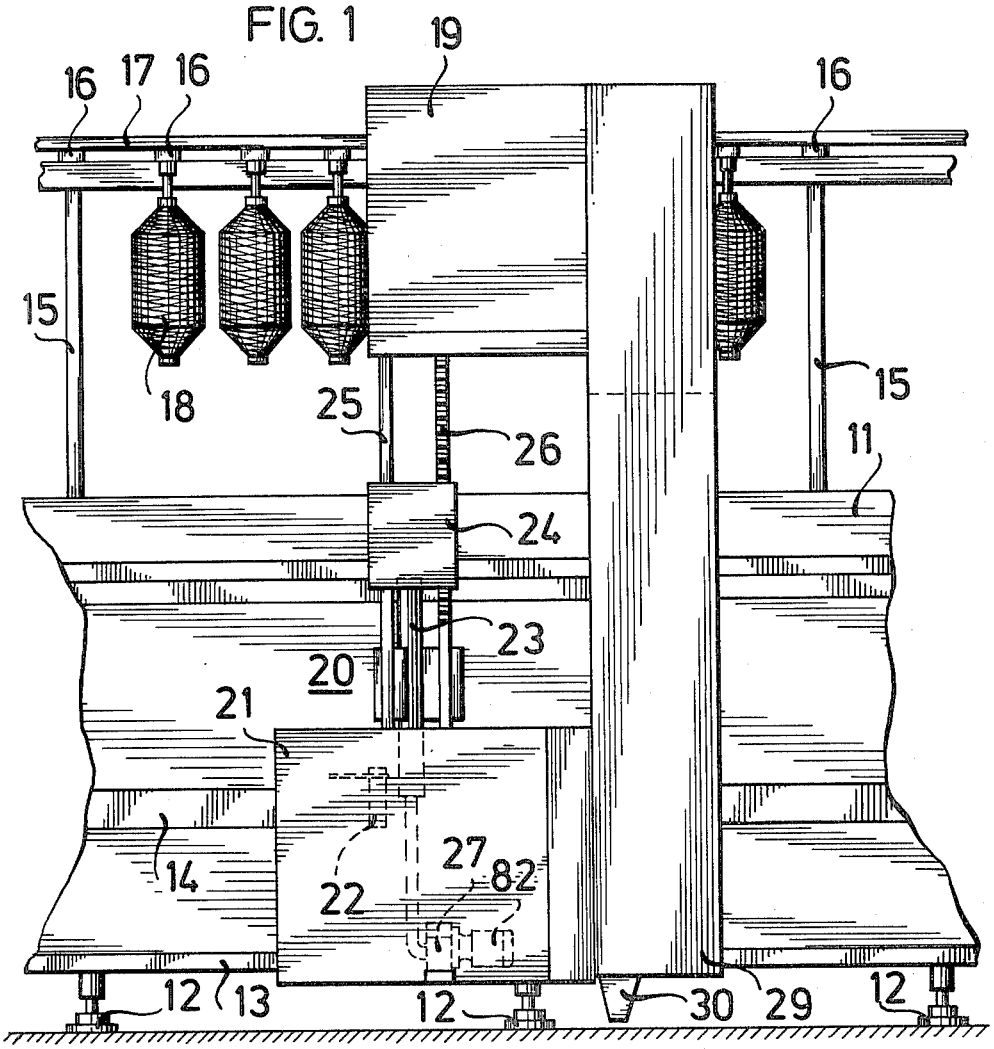
FIG. 1 is an elevational view of a device being deployed in front of a ring spinning frame.

Referring now to the drawing and first, particularly to FIG. 1, thereof, there is shown a fragmentary diagrammatic view of a ring spinning frame or machine 11 with support legs 12, a base rail 13 of a reciprocatingly displaceable ring rail 14 and head supports 15 with cross beams 16 which carry a head rail 17 and from which roving bobbins or coils 18 are suspended.

Figure 2:
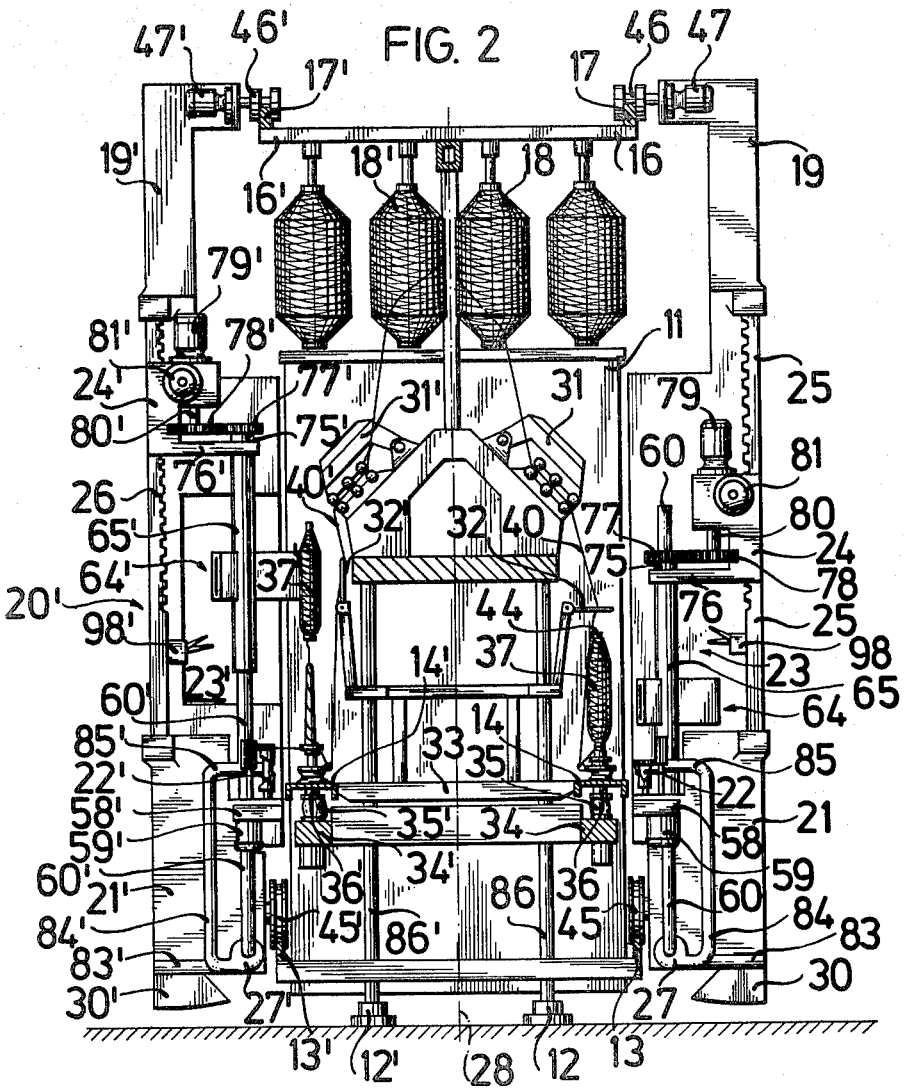
FIG. 2 is a vertical cross sectional view of a double-sided ring spinning frame with two devices according to the invention, which and operative on each side of the spinning frame.

A device generally identified by the reference numeral 19 is movably supported on the rail 13 and 17, as can be seen especially in FIG. 2. The device per se for automatically removing the coils is identified as a whole by the reference numeral 20. Of this device 20, there is visible in FIG. 1 a coil container 21, a tube or coil loosener 22, a coil transporter 23, an elevating-mechanism drive 24 for the coil transporter 23, two vertically disposed toothed racks 24 and 26 for the elevating-mechanism drive 24 and an exhauster 27 for the coil transporter 23.

From FIG. 2, it can be seen that most of the aforementioned parts are duplicated and appear again at the left-hand side of the symmetry line 28 for the left-hand side of the machine or frame, as well, and are thereby identified by the same reference numerals, each with a prime added thereto.

The movable device 19 also has a cleaning member 29 with a base suction nozzle 30. The other functions of the movable device 19 and the cleaning member 29 thereof will not be described herein in detail since such description is believed not to be necessary for an understanding of the invention.

In FIG. 2 of the drawing, further details of the device of the invention can be seen. The ring spinning frame 11 includes a drawing mechanism 31, an articulatingly suspended thread guide 32 which is upwardly withdrawable or yieldable, a ring rail elevating device 33, a spindle rail 34 and a tangential belt 35 serving to drive the spindles.

Both sides of the ring spinning frame 11 are armed with spindles disposed adjacent one another and supported in the respective spindle rails 34. One of the spindles 36 is seen in the right-hand half of the spinning frame 11 and one of the spindles 36' in the left-hand half of the machine.

FIG. 2 of the drawing illustrates a phase of operation of the ring spinning frame 11 wherein the spinning frame has shut down because the coils 37, 37', as well as the other coils, have reached the nominal fullness.

Figure 7:
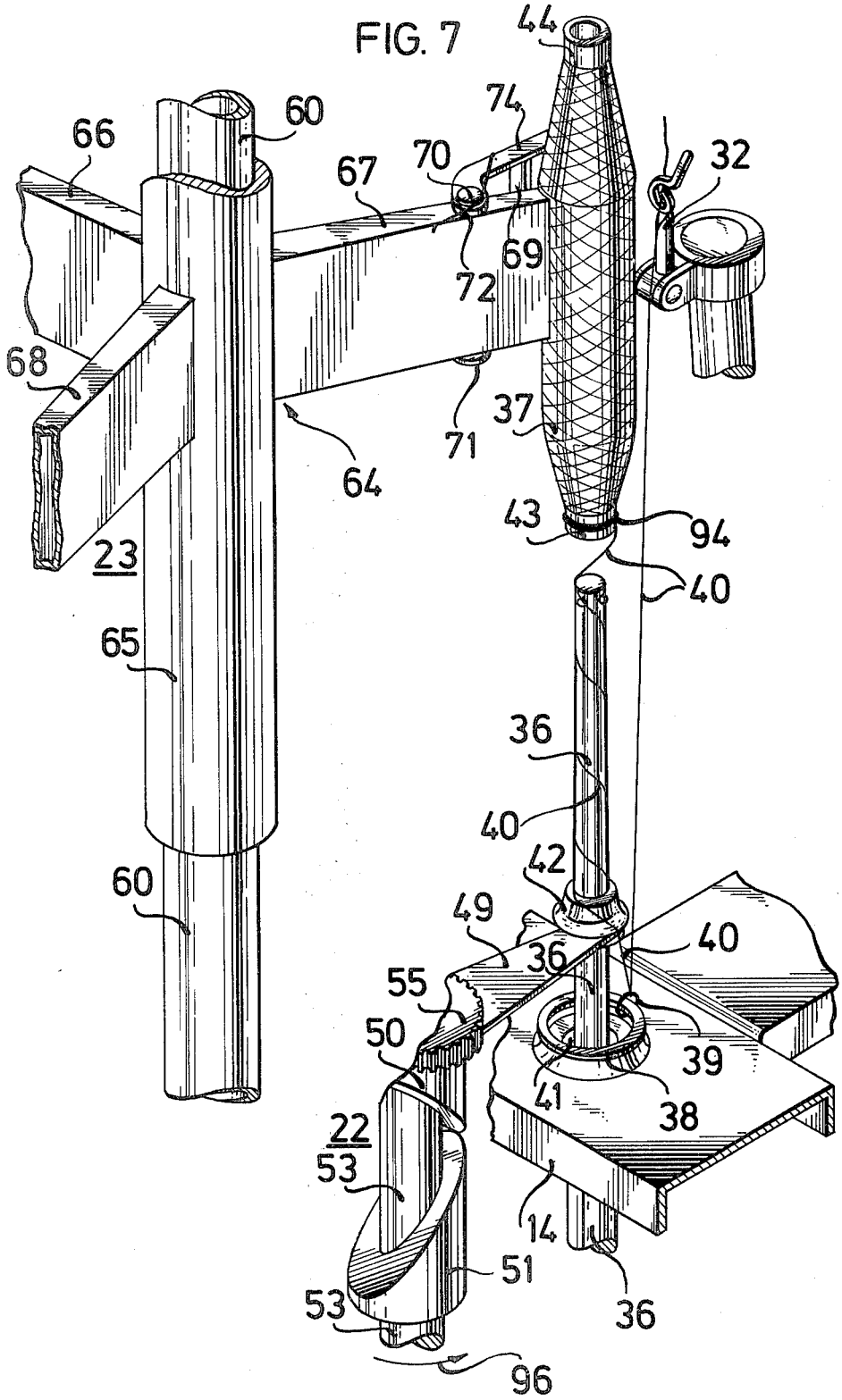

FIG. 7 shows especially clearly that the ring rail 14 carries a spinning ring 38, whereon a ring traveler 39 can revolve. The thread 40, coming from above, as shown in FIG. 7, is threaded through the ring traveler 39 and extends therefrom to the spindle 36 and the coil 37. On the spindle 36, there is fastened a ring 41 which serves as lower support or bearing for a releasing or disengaging ring 42 which is axially displaceable on the spindle 36. The releasing ring 42 has a smooth outer surface. The upper diameter of the releasing ring 31 exactly as large as the outer diameter of the foot or base 43 of the coil core or tube 44.

The traveling device 19 has flanged wheels 45 which roll on the base rail 17 and flanged wheels 46 which roll on the head rail 17, as shown in FIG. 2. A propulsion motor 47 serves to drive the flanged wheel 46.

As can be seen especially from the perspective fragmentary views of the device according to the invention shown in FIGS. 4 to 8, the coil core or tube loosener 22 is formed of a gripper 49 which is pivotable in direction of the arrow 48 and back again and is fastened to the upper part 50 of a sleeve 52 which is cut across obliquely to the longitudinal axis thereof. The lower part 51 of the sleeve 52 is connected to a shaft 53 which extends through a crosspiece or traverse 54 from below and projects upwardly beyond the gripper 49 and a gear 55 connected to the gripper 49. The mutually connected parts 48, 50 and 55 are shiftably mounted on the shaft 53. The gear 55 is drivable by a pinion 56 which is mounted on a shaft 57 likewise extending through the crosspiece of traverse 54 from below. As shown in FIG. 2, both shafts 53 and 57 terminate beneath the crosspiece or traverse 54 in a gear box 58 to which a motor is flanged.

Figure 4:
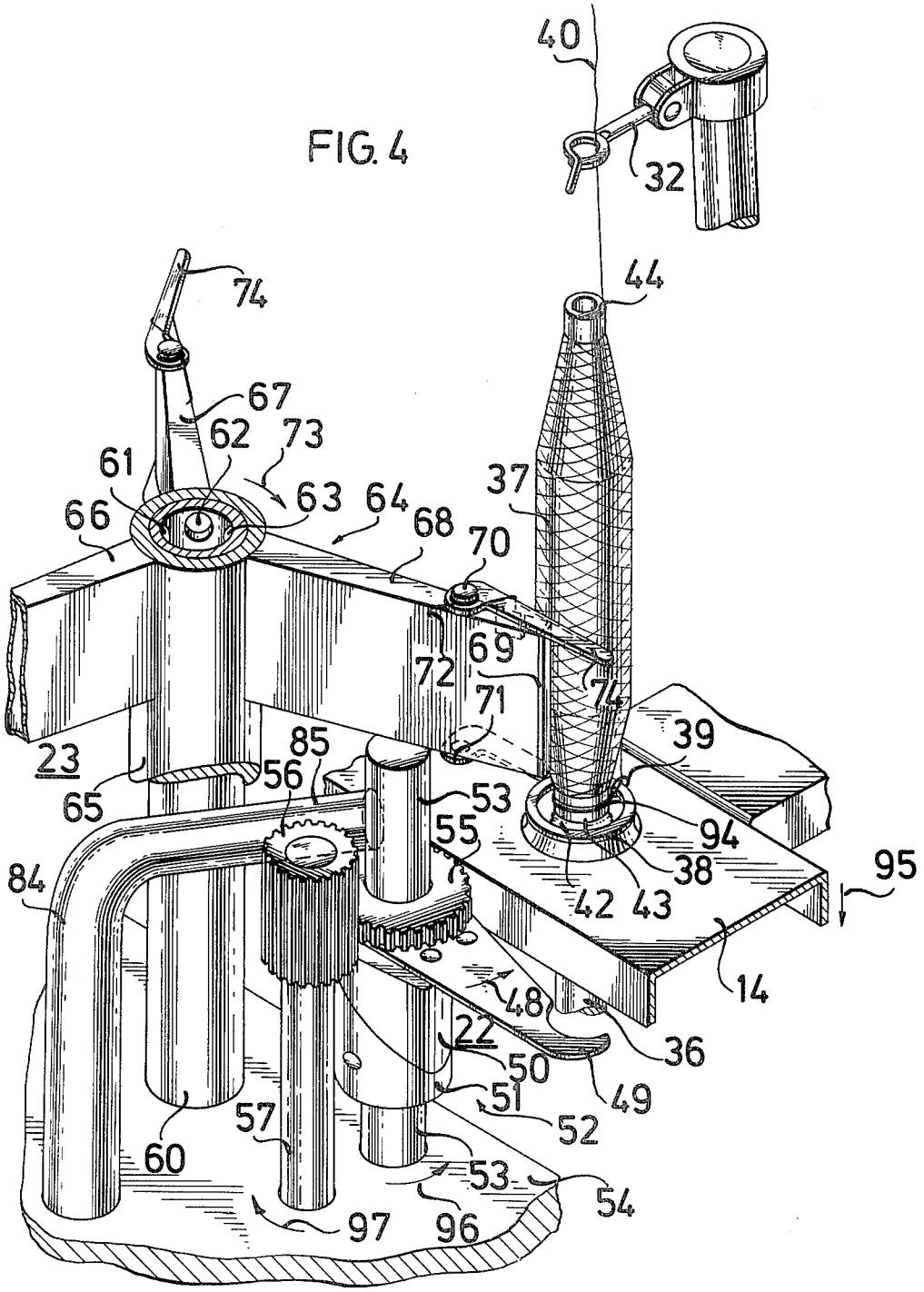
FIGS. 4 to 8 are fragmentary enlarged perspective views of the device in various modes of the operation thus serving to explain the coil removal operation according to the method of the invention.

As shown in FIGS. 2 and 4, the coil transporter 23 is formed of a tube 60 which is perforated in a middle part thereof over the entire periphery of the tube 60. Some of the perforations 61, 62 and 63 formed in the tube 60 are visible in FIG. 4. A lifting or elevating device 64, which is easily movable and also rotatable, is disposed over the tube 60. The lifting or elevating device 64 is formed of a tube 65 which is equipped with three coil grippers 66, 67 and 68 that are uniformly distributed over the circumference thereof. The tube 65 is of such length that it covers, in every position thereof, the perforations 61, 62 and 63 formed in the tube 60.

The coil grippers 66, 67 and 68 are constructed as pneumatically action suction nozzles. The nozzle mouths, respectively, form a vertically disposed slot which is coverable by a hinged flap 69. To this end, the flap 69 has two articulating joints 70 and 71. At the articulating joint 70, there is a wound coil spring 72, prestressed in tension, which holds the flap 68 in the closed position thereof. Then the tube 65 is rotated in direction of the arrow 73, a lever 74 connected to the flap 69 comes into contact with the coil or bobbin 37, whereby the flap 69 is opened against the force of the spring 72.

It is apparent from FIG. 2 that the tube 65 has, at the upper end thereof, a shoulder or collar 75, under which a crosspiece or traverse 76 of the elevating-mechanism drive 24 engages. Above the shoulder or collar 75, there is a gear 77 which is also connected firmly to the tube 65. The lifting or elevating-mechanism drive 24 has a stepping motor 79, with a shaft 80 on which there is fastened a gear 78 which meshes with the gear 77. At the lifting or elevating-mechanism drive 24, there is provided further stepping motor 81 having a shaft to which two gears, which are not illustrated in FIG. 2, are fastened and mesh with the teeth of the racks 25 and 26.

The tube 60 terminates in the exhauster 27 on the suction side below the crosspiece or traverse 54. The exhauster 27 is driven by a motor 82, as can be seen from FIG. 1. From the blow-off line 83 of the exhauster 27, a branch line 84 leads to a blast nozzle 85 directed toward the spinning ring 38.

Figure 3:
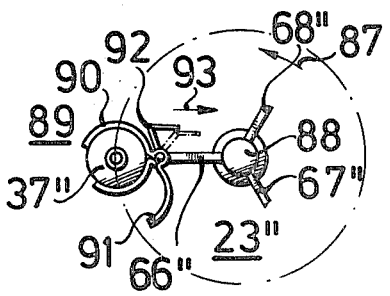
FIG. 3 is an enlarged fragmentary top plan view of FIG. 2 showing an alternative embodiment of the coil transporter of the device according to the invention.

Guide rods 86, 86' serve for stabilizing the spinning frame and, simultaneously, for sliding guidance of the spindle rail 34, the ring rail elevating device 33 and the thread guide 32. All of the hereinaforementioned parts of the device 20 for automatically removing a coil are provided, according to FIG. 2, also in the device 19' which is capable of traveling in front of the left-hand spinning frame half, and these corresponding parts are identified by the same reference numerals with the addition of a prime. In FIG. 3, a modified form 23" of the coil transporter 23 of FIG. 2 is shown in a top plan view. The coil transporter 23" of FIG. 3 is formed of a rod 88 which can be raised and lowered and is rotatable about the longitudinal axis thereof in direction of the arrow 87, and which simultaneously carries coil grippers 66", 67" and 68" which are uniformly distributed about the periphery thereof. At the end of each coil gripper 66", 67" or 68", a mechanically acting gripper of clamp 89 is provided. This gripper clamp 80 is formed of a stationary lower clamp part 90 and an articulatingly fastened upper clamp part 91. An actuating lever 92 is attached to the upper clamp part 91.

In order to seize a coil 37", the coil transporter 23" is swung in direction of the arrow 87 until the lower clamp part 90 engages the coil 37". Then, the actuating lever 92 is drawn in direction of the arrow 93 until the upper clamp part 91 also firmly engages the coil 37".

The automatic removal of the coil 37 from the spindle 36 will now be described with reference to FIGS. 4 to 8 of the drawing.

It is assumed that all coils or bobbins of the ring spinning frame are completed. The ring rail 11 has been moved downwardly, so that the spinning ring 38 is at the level of the tube or coil-core base 43. The ring traveler 39 has already wound a foot or base-winding 94 on the foot or base 43 of the coil core or tube. The same has occurred at all coils of the ring spinning frame.

According to FIGS. 2 and 4, the traveling device 19 has stopped in front of the coil 37 to start its activity there. The coil transporter 23 is in rest or neutral position thereof. The coil grippers 67 and 68 are positioned so that the traveling device 19 can travel past the ring spinning frame 11 unimpeded. The exhauster 27 is switched on, so that the interior of the tube 60 is at negative pressure or underpressure. Since the flaps 69 of all of the coil grippers 67, 68 and 69 are closed and the tube 60 is also sealed off at the upper end thereof, the exhauster 27 exhausts only leakage air which, however, is sufficient to let air in a secondary flow escape through the branch line 84 from the blast nozzle 85. The air escaping from the blow nozzle 85 has shifted the ring traveler 39 on the spinning ring 38 in such a manner that it is disposed behind the coil 37 and cannot interfere with the operations of the device 20 for removing the coils.

The coil core or tube loosener 22 is likewise in the rest or neutral position thereof. The coil core loosener 22 cannot yet become operative because the ring rail 14 must first be shifted to a slight extent downwardly in direction of the arrow 95. As soon as this has occurred, the gripper 49 of the coil core or tube loosener 22 is swung in direction of the arrow 48. This is accomplished by rotating the shaft 53 in direction of the arrow 96 and by simultaneously rotating the shaft 57 in opposite rotary direction as indicated by the arrow 97. The rotation of the shafts 53 and 57 is effected by a conventional mechanism provided in the gear box 58 (FIG. 2) and driven by the motor 59.

Figure 5:
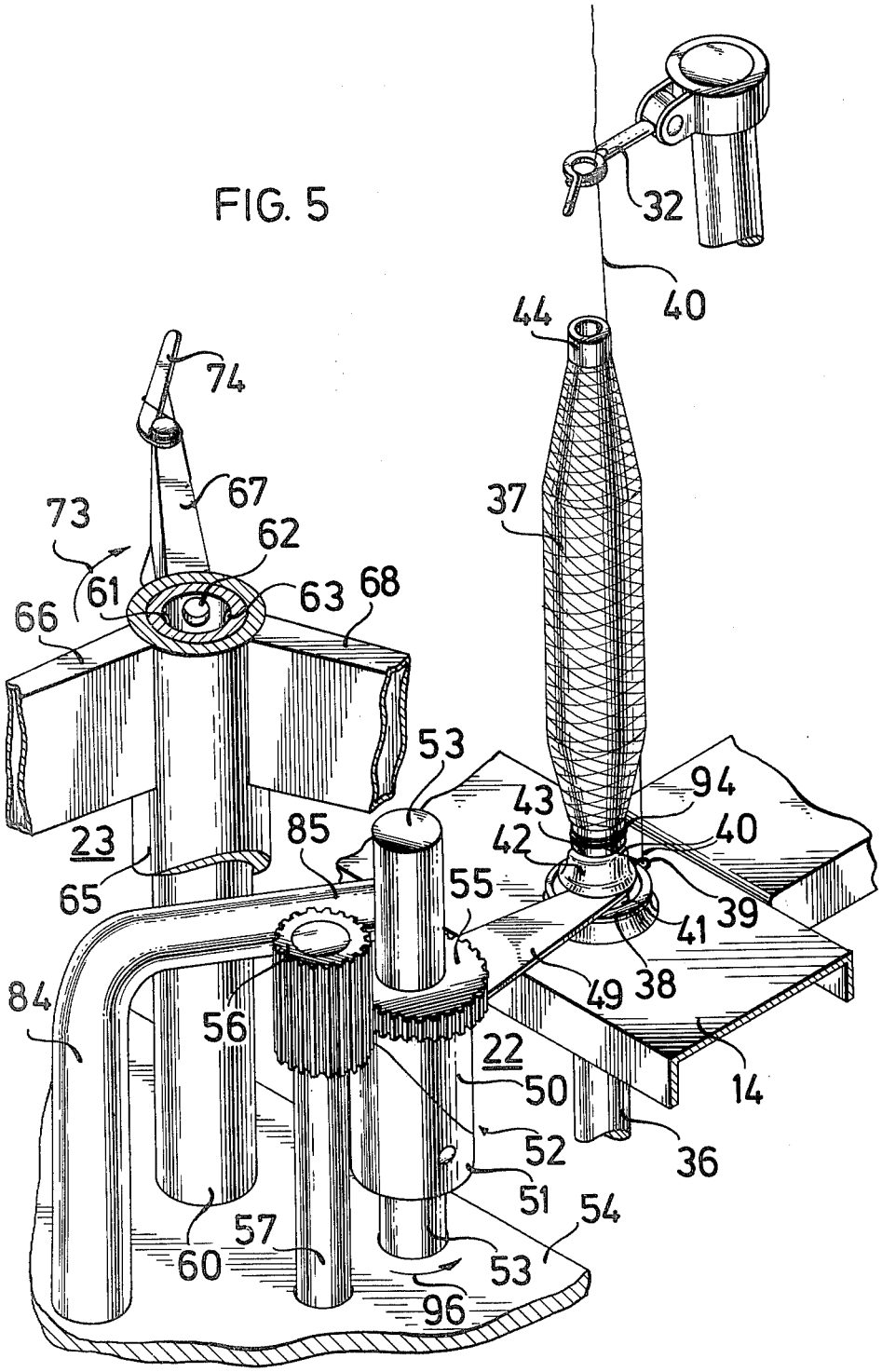
Figure 6:
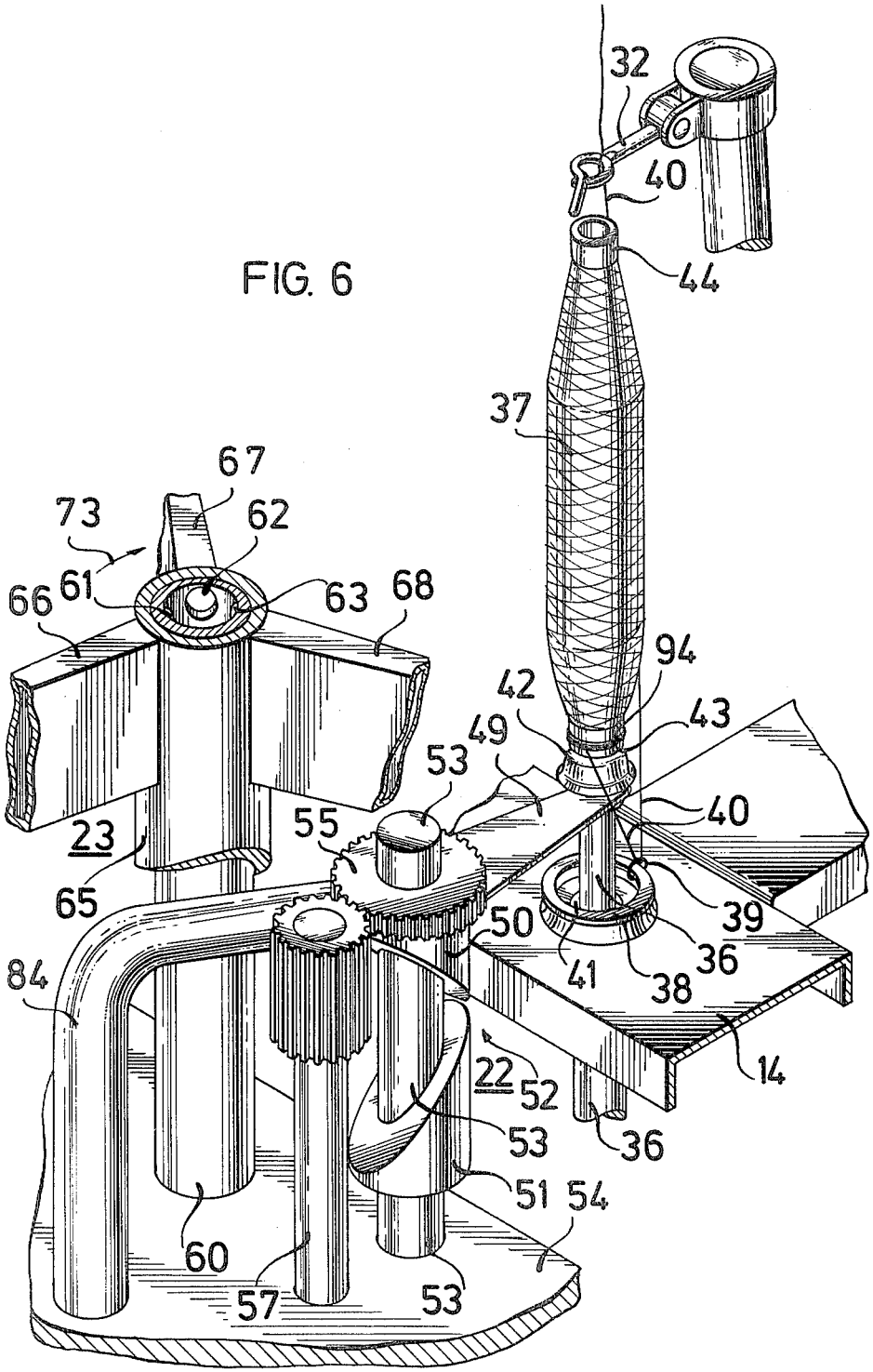

The upper part 50 and the lower part 51 of the divided sleeve 52 are now turned simultaneously from the rest or neutral position thereof shown in FIG. 4 to the position thereof shown in FIG. 5. Accordingly, the gripper 49 engages the shaft 36 at a location thereof following the releasing ring 42 and above the bearing ring 11.

The shaft 53 is then turned half a revolution farther in direction of the arrow 96 while the shaft 57, however, remains motionless. Due to the rotation of the shaft 53, the upper part 50, driven by the shaft 53, slides upwardly on the lower part 51 of the divided sleeve 52. At the end of this sliding movement, the gear 55, the upper part 50 of the sleeve 52, the gripper 49, the releasing ring 49 and the coil 37 have assumed the position thereof shown in FIG. 6. It is apparent from FIGS. 2 and 6 that the thread 40, coming from the drawing mechanism, is passed through the thread guide 32 and the ring traveler 39 so that the latter is suspended therefrom, and is connected to the base winding 94 of the coil 37. The coil 37 is then already released or separated from the spindle 36.

The coil transporter 23 can then become operative. To this end, the stepping motor 79 (FIG. 2) is switched on and turns the tube 65, by means of the gears 78 and 77 so far in direction of the arrow 73 that the coil gripper 67 is located exactly in front of the coil 37. As shown especially in FIG. 7, the lever 74 associated with the coil gripper 67 thereby engages the coil 37, whereby the flap 69 opens and the coil 37 is firmly held by suction air at the mouth of the coil gripper 67.

The instant this has happened, the stepping motor 81 is switched on whereupon the entire elevating device 64 is raised, as is demonstrated in FIG. 2 on the left-hand side of the spinning frame by the particular illustrated embodiment of the coil transporter 23'. The corresponding position of the tube 65 and the coil 37 is shown in perspective view in FIG. 7. It is apparent from FIG. 7 that the thread guide 32 has automatically withdrawn upwardly and has assumed a vertical position. The thread 40 further extends from the thread guide 32 through the ring traveler 39 to the base or foot winding 94 of the coil 37. Any turns sloughed off from the base winding 94 have become disposed in a desirable manner around the spindle 36.

Two operations are then simultaneously performed automatically. The one operation concerns the lowering of the releasing ring 42 into the starting position thereof, and the other operation the further transportation of the coil 37 to the coil container 21.

Figure 8:
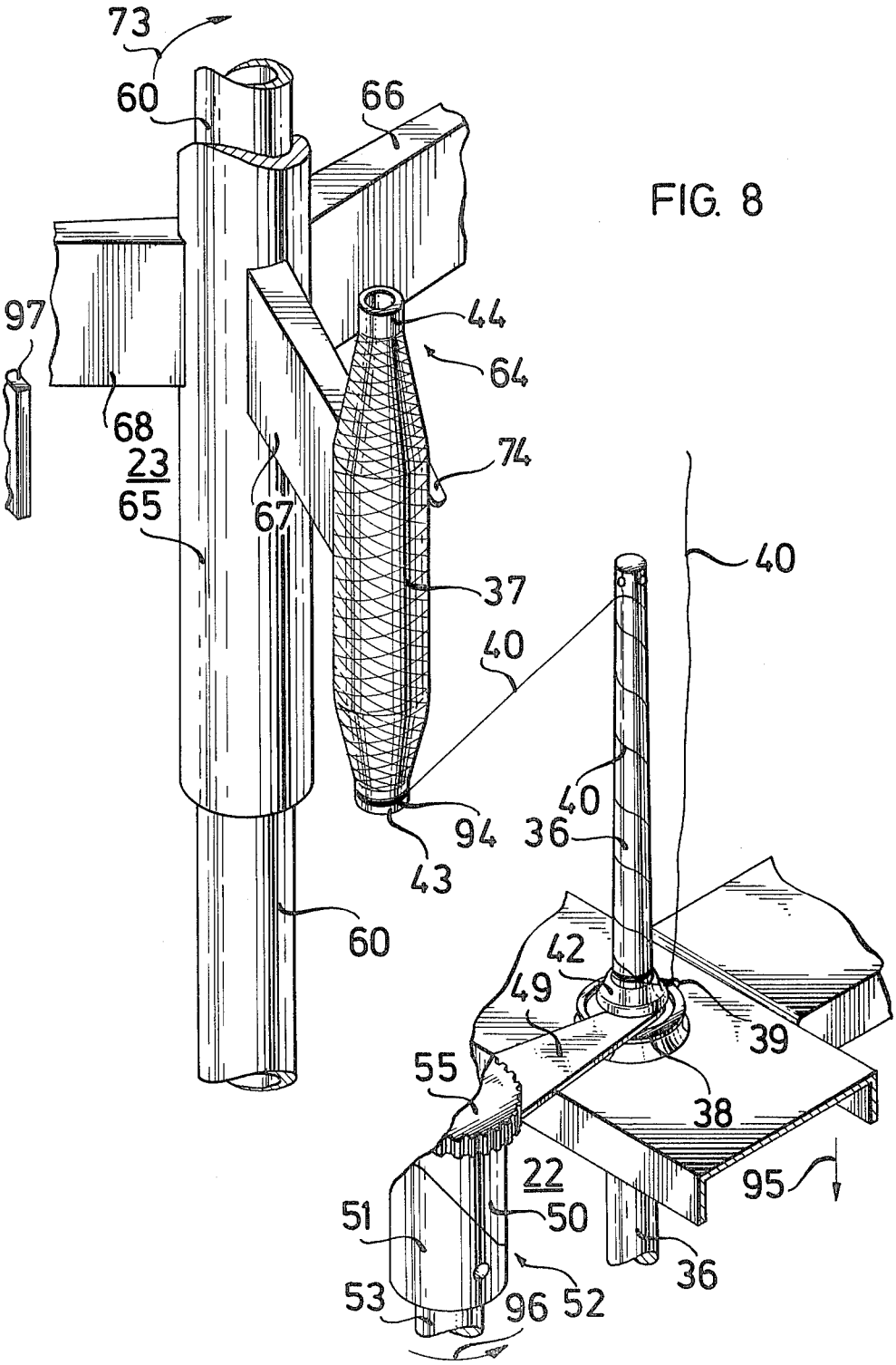

To lower the releasing ring 42, the shaft 53 is turned half a revolution in direction of the arrow 96. The upper part 50 of the divided sleeve 52 accordingly slides downwardly together with the gear 55 and the gripper 49 on the shaft 53. The releasing ring 42 disposed on the gripper likewise slides downwardly on the spindle 36 of its own weight. FIG. 8 of the drawing shows the position of the parts after the releasing ring 42 has been lowered. FIG. 8 coincidently shows that the elevating device 64 also has been turned farther in direction of the arrow 73 by the stepping motor 79 of the elevating device actuator 24. The rotary motion is continued until the coil gripper 67 is disposed in front of a stop 97. In the course of travel of the coil gripper 67 toward the stop 97, the thread 40 is delivered into the severing range of a thread cutter or shears 98, as shown in FIG. 2. The thread cutter 98 is forcibly controlled in accordance with the position of the elevating device 64. Upon further rotation from the position shown in FIG. 8, the coil 37 is thrown off by the stop 97 after the thread 40 is severed. The coil 37 then falls into the coil container 21 (FIGS. 1 and 2).

The coil removal process per se is now completed. Before the traveling device 19 moves to the next spindle, the gripper 49 is initially brought back to the starting position thereof. According to FIG. 4, viewed together with FIG. 8, this is accomplished by turning the shaft 57 in the direction opposite that of the arrow 97 and simultaneously turning the shaft 53 in the direction opposite the arrow 96.

To set the spinning station into operation again, an empty coil tube must be stuck onto the spindle 36 and the thread guide 32 flipped back into the operating position thereat. Both of these operating steps can be performed in different ways. One possibility is to perform these steps manually. In a second possibility, a separate traveling device is used for this purpose. In a third possibility, the traveling device 19 is suitably equipped therefor. This, however, is of no importance to the specific subject of the invention.

The end of the thread 40 remains wound in several turns around the spindle 36 before a new coil core or tube is stuck onto the latter. The coil core or tube consequently clamps this thread end against the spindle 36, so that special measures for securing the thread end to the coil tube or core are unnecessary.

After new coil tubes or cores have been stuck onto the spindles of the entire spinning frame, the ring rail 14 is raised in the direction opposite that of the arrow 95 and, then, the tangential belt 36 which drives the spindles is set in motion.

As mentioned hereinbefore, the invention is not limited to the illustrated and described embodiment. If mechanically acting grippers or clamps are used, the tube 60 need no longer be subjected to underpressure or negative pressure. In that case, the exhauster 27 would work as a simple blower. It has then only to supply the compressed air for blowing against the spinning rings.

Before the device 20 becomes operational at the next spindle, the stepping motor 81 is switched to reverse rotation, whereby the elevating device drive 24 is returned on the racks 24 and 26 to the starting position thereof, so that the elevating device 64 also returns to the starting position thereof shown at the right-hand side of FIG. 2.

All operations described hereinbefore are advantageously controlled by a heretofore known fixed or variably programmed program-control switch or timer mechanism of conventional construction, the specific construction of which forms no part of this invention.

There are claimed:

1. In a ring spinning or twisting frame having a traveling device drivable from work station to work station along the frame for successively removing coils from the spindles automatically, the improvement therein comprising an axially displaceable coil-core releasing ring operatively associated with each spindle of a respective work station at a location below a respective foot of a coil-core receivable on the spindle; the traveling device having means connectible with said releasing ring for releasing a coil core from a respective spindle whereon the coil core is mounted, and having a coil transporter connectible to the respective coil-core, said coil-core releasing means being pivotable and limitedly reciprocable, said coil-core releasing means being actuatable in a first operating cycle for releasing a coil core, and said coil transporter being actuatable in a second operating cycle for transporting the coil core away from the respective spindle.

2. Device according to claim 1 including a spinning or twisting ring located at the respective work stations, and said traveling device has blasting means comprising a blasting nozzle directed toward said last-mentioned ring.

3. Device according to claim 1 or 2 wherein said releasing ring has a smooth outer surface and a diameter at an upper end thereof that is at most equal to the outer diameter of the foot of the coil core.

4. Device according to claim 1 wherein said coil transporter has an elevating device rotatable about an axis parallel to the respective spindle axis, said elevating device comprising a substantially cylindrical member and at least two coil grippers distributed about the circumference thereof, said coil grippers being activatable and de-activatable sequentially.

5. Device according to claim 4 wherein said coil grippers are mechanically acting gripper clamps.

6. Device according to claim 4 wherein said coil grippers are pneumatically acting suction nozzles.

* * * * *